United States Patent [19]

Hoeksma

[11] Patent Number: 4,988,920

[45] Date of Patent: Jan. 29, 1991

[54] HIGH-FREQUENCY POWER CIRCUIT FOR GAS DISCHARGE LAMPS

[75] Inventor: Gerben S. Hoeksma, Winterswijk, Netherlands

[73] Assignee: N.V. Nederlandsche Apparatenfabriek Nedap, De Groenlo, Netherlands

[21] Appl. No.: 306,944

[22] Filed: Feb. 7, 1989

[30] Foreign Application Priority Data

Feb. 8, 1988 [NL] Netherlands ..... 8800288

[51] Int. Cl.[5] ..... H05B 41/24

[52] U.S. Cl. ..... 315/101; 315/DIG. 5; 315/DIG. 7

[58] Field of Search ..... 315/101, DIG. 7, DIG. 5, 315/98, 102, 105, 219

[56] References Cited

U.S. PATENT DOCUMENTS

| | | | |
|---|---|---|---|
| 3,619,713 | 11/1971 | Biega | 315/105 |
| 3,657,598 | 4/1972 | Nomura et al. | 315/209 R |
| 4,087,722 | 5/1977 | Hancock | 315/200 A |
| 4,286,195 | 8/1981 | Swinea, Jr. | 315/224 |
| 4,392,087 | 7/1983 | Zansky | 315/219 |
| 4,464,606 | 8/1984 | Kane | 315/DIG. 7 X |

FOREIGN PATENT DOCUMENTS

| | | |
|---|---|---|
| 3140175 | 4/1983 | Fed. Rep. of Germany . |
| 3248017 | 7/1984 | Fed. Rep. of Germany . |
| 2446579 | 11/1978 | France . |
| 927188 | 5/1963 | United Kingdom . |
| WO83/01313 | 4/1983 | World Int. Prop. O. . |

*Primary Examiner*—Eugene R. LaRoche
*Assistant Examiner*—Ali Neyzari
*Attorney, Agent, or Firm*—Fleit, Jacobson, Cohn, Price, Holman & Stern

[57] ABSTRACT

A high frequency power circuit for energizing at least one gas discharge lamp with two filaments. The circuit is adapted to be supplied with power from a DC voltage source, and comprises semiconductor switching elements and control means for the semiconductor switching elements. The circuit also comprises a high frequency transformer having at least one primary winding which, in operation, is supplied with an AC voltage signal by the semiconductor switching elements. The transformer has at least one secondary main winding and secondary auxiliary windings. The secondary auxiliary windings, in operation, energize the filaments of the at least one gas discharge lamp. The control means are adapted to disconnect, in a stand-by mode, by at least one controllable switching means. The connection between the at least one secondary main winding and the at least one gas discharge lamp. The control means are also adapted to supply, in the stand-by mode, such an AC voltage signal to the at least one primary winding that the filaments of the gas discharge lamp(s) are preheated through the secondary auxiliary windings.

17 Claims, 3 Drawing Sheets

HIGH-FREQUENCY POWER CIRCUIT FOR GAS DISCHARGE LAMPS

BACKGROUND OF THE INVENTION

This invention relates to a high-frequency power circuit for energizing at least one gas discharge lamp with two filaments, said circuit being adapted to be supplied with power from a DC voltage source, said circuit comprising semiconductor switching elements and control means for the semiconductor switching elements, as well as a high-frequency transformer having at least one primary winding which, in operation, is supplied with an AC voltage signal by the semiconductor switching elements, and having at least one secondary main winding and secondary auxiliary windings, said secondary auxiliary windings, in operation, energizing the filaments of the at least one gas discharge lamp.

Particular requirements are imposed on power circuits suitable for feeding one or more gas discharge lamps exposing an original document in a copying machine, electronic document scanner or comparable apparatus. In such circumstances, the gas discharge lamps should be capable of being switched on and off a great many times (e.g. one million times), and high standards are exacted as to the stability of the lamp luminance. It is also desirable that very quickly after transmission of a control command, e.g. after 10 to 100 milliseconds, the lamps are lit and give the desired luminance. It is also often desirable that the lamp luminance is adjustable over a relatively large range. High-frequency power circuits for these purposes are known e.g. from the publications DE 3528549, USA 4,251,752, USA 4,286,195, DE 3248017, USA 4,087,722, EP-A 0104264 and USA 3,657,598. In these known circuits, an input voltage is converted into a high-frequency voltage, which is supplied to one or more gas discharge lamps by means of one or more semiconductor switching elements, such as transistors or thyristors. Different methods are used here to limit the current through the gas discharge lamps. In some cases, the luminance of the lamps is controlled by controlling the duty cycle of the switching elements or by supplying high-frequency burst signals to the lamps. However, in none of the known circuitries, is any special attention paid to the firing process of the lamp, in particular not to the load of the filaments of the lamp during firing. Furthermore, practice has shown that the known luminance control circuitries sometimes exhibit instabilities which need not be a drawback for non-critical applications but which are intolerable for application in e.g. a copying machine.

SUMMARY OF THE INVENTION

It is an object of the present invention to provide an effective, universally applicable power circuit for gas discharge lamps and in particular a power circuit meeting the aforementioned requirements and thereby being especially suitable for application in a copying machine or like apparatus.

To that effect, according to the present invention, a high-frequency power circuit of the above described type is characterized in that the control means are adapted to disconnect in a stand-by mode, by means of at least one controllable switching means, the connection between the at least one secondary main winding and the at least one gas discharge lamp, and to supply in the stand-by mode such an AC voltage signal to the at least one primary winding that the heating filaments of the gas discharge lamp(s) are preheated through the secondary auxiliary windings.

BRIEF DESCRIPTION OF THE DRAWING

Some embodiments of the present invention will now be described, by way of example, with reference to the accompanying drawings, in which.

DETAILED DESCRIPTION OF THE PREFERRED EMBODIMENT

Figure 1:
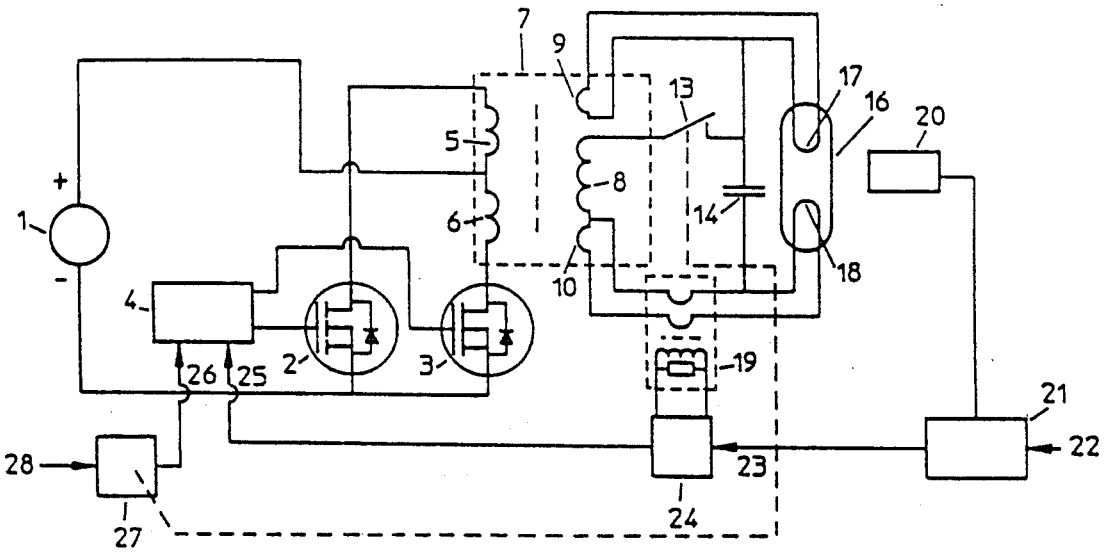
FIG. 1 shows an electric diagram of a first embodiment of a power circuit according to the present invention.

FIG. 1 shows an electric diagram of an embodiment of a power circuit according to the present invention which, in operation, is connected to a DC voltage source 1. The power circuit shown comprises a transformer 7 having a primary winding including in this embodiment two parts 5 and 6, a secondary main winding 8 and two secondary auxiliary windings 9 and 10, serving for energizing the filaments 17, 18 of a gas discharge lamp 16. The transformer is a leakage transformer whose secondary main winding, as shown, is connected to at least one resonance capacitor 14, to thereby form a resonance circuit whose frequency is determined by the capacitance of the capacitor 14 and the leakage self-inductance of the transformer, as manifests itself at the secondary end of the transformer.

The secondary main winding 8 is further connected, through a controllable switching means 13, e.g. a relay contact, to the terminals of the gas discharge lamp. In the stand-by mode, consequently, the winding feeding the lamp is interrupted, e.g. by a relay. If desired the resonance capacitor can be disconnected too, thereby controlling the input voltage in such a manner that the filaments of the lamp(s) are heated to such an extent that, on the one hand, the lamp(s) can start immediately without requiring a high voltage across it (them), and, on the other, in the stand-by mode unnecessary wear of the filaments that would inadmissibly shorten the life of the lamp(s) is avoided. In this manner, the emission of material and hence wear during starting is avoided, too.

Transistors 2 and 3 together with the properly interconnected primary windings 5,6 of a transformer 7, form a push-pull converter. Transistors 2,3 function as switching transistors and are activated by a control circuitry 4. When a control signal 28 prescribes the stand-by mode, a circuit 27 opens the contact 13, while through a signal 26, the control circuitry 4 is maintained in the stand-by mode, with transistors 2,3 being conductive alternately with a relatively short duty cycle. The duty cycle is so adjusted that the voltage supplied by the secondary auxiliary windings 9,10 of transformer 7 to the filaments 17,18 of lamp 16 has the desired effective value.

When it is prescribed to switch on the lamp(s) via control signal 28, preferably first switching transistors 2,3 are both cut off and contact 13 is closed. Subsequently, switching transistors 2,3 are alternately fired, with gradually increasing duty cycle until a duty cycle of almost fifty percent for each of the transistors is reached. The frequency, at least during switching-on when the maximum lamp luminance is attained, is about equal to that of the resonance circuit formed by the leakage inductance of transformer 7 and the resonance capacitor 14. The resistance of the lamp is then relatively high, so that the quality factor Q of the circuit is high. The effect now is that the voltage across the lamp has a sine shape of gradually increasing amplitude. The earlier mentioned interruption of the activation of transistors 2,3 is so brief that the filaments of the lamp are not cooled off appreciably. When a given, relatively low voltage across the lamp is attained, the gas discharge is started. It has been found experimentally that if a gas discharge lamp is fired in this manner, a lamp life of over one million times switching-on and -off can be achieved.

In the embodiment shown in FIG. 1, a square-shaped or trapezoidally shaped, symmetrical AC voltage signal is presented to the primary winding 5,6 through transistors 2,3 or other suitable semiconductor switching elements, owing to the transistors being alternately conductive and owing to the transistors being each connected between one of the ends of the primary winding and the one pole of the DC voltage source, while the center tap of the primary winding is connected to the other pole of the DC voltage source. This symmetrical energization without a DC voltage component promotes a long life of the gas discharge lamp(s).

The power circuit shown in FIG. 1 further comprises a current measuring circuit 19 adapted to very quickly measure the current flowing through the gas discharge lamp(s). The current measuring circuit may advantageously be a current transformer, which is formed by a winding provided around the two connecting wires of one of the filaments of the lamp(s). In this manner, it is only the lamp current and not the current flowing through the filaments that is measured.

The current measuring circuit passes the measured lamp current to a comparator circuit 24, which compares it with a desired value of the lamp current 23. When the lamp current is too high, the frequency at which the switching transistors 2,3 are switched is increased through signal 25 and control circuit 4, with the duty cycle being maintained at almost fifty percent. The effect is that the lamp current decreases due to the filter effect of the resonance circuit. In fact, the control frequency which, as it is, in normal operation, is slightly above the resonance frequency of the resonance circuit formed by the leakage inductance and the resonance capacitor, is now in a frequency range in which the resonance circuit behaves as a low-pass filter. The control frequency continues to be changed until the desired and the actual value of the lamp current are identical. It is observed that, in the short term (i.e. within one cycle of the switching frequency, which may take five to fifty microseconds), a gas discharge lamp presents itself as a resistance load. In a somewhat longer term, which has to do with the transit time and recombination time of the charge carriers in the gas, a time in the order of 100 microseconds to 1 millisecond, the gas discharge lamp exhibits a negative characteristic. This means that when a lower current is supplied to the lamp, the voltage across the lamp precisely increases.

Figure 2:
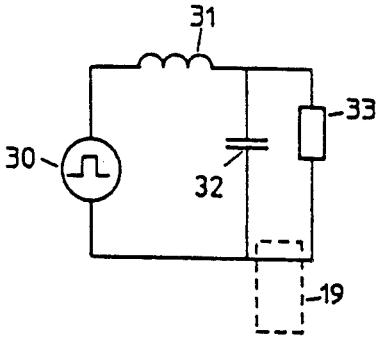
FIG. 2 shows an equivalent diagram of a part of FIG. 1.

This is further elucidated on the basis of the equivalent diagram of FIG. 2. The voltage source 30 produces a square-shaped voltage of variable frequency corresponding with the voltage across winding 5,6 of FIG. 1, transformed to the secondary side of the transformer. The inductor 31 represents the leakage inductance of the transformer in relation to the secondary winding. Capacitance 32 corresponds with capacitor 14 from FIG. 1. Resistor 33 represents the load formed by the gas discharge lamp. The filament load is disregarded in the first instance. The situation at full power is as follows:

The frequency of source 30 is then about equal to the resonance frequency of the circuit, formed by inductor 31 and capacitor 32. Furthermore, the dimensioning is such that resistor 33 has the same value or a slightly lower value, to a factor of two to three, as the absolute value of the impedance of inductor 31 and capacitor 32 at the resonance frequency. The circuit is now thus attenuated and has a low quality factor Q. When subsequently, the frequency of source 30 is increased, the impedance of inductor 31 increases, and therefore less current is supplied to capacitor 32 and resistor 33. After some time, a higher value is imparted to resistor 33 due to the negative lamp characteristic. Now, the voltage across the lamp is slightly higher and more current flows through capacitor 32 and less through resistor 33. The lamp current control circuit comprises a sample-hold circuitry for a stable control. Each time, at the maximum value of the voltage across resistor 33, the current is measured with current measuring transformer 19 and sampled and held in block 24 from FIG. 1 and compared with the desired value 23. This ensures a quick and stable control. This rapid control is especially important with minimum lamp current. A slight decrease in lamp voltage may then entirely extinguish the lamp and necessitate a restart at strongly increased voltage. The rapid control detects any reduction in lamp current within one cycle of the switching frequency and controls the lamp voltage in the next switching cycle slightly upwards, so that the gas discharge continues.

Figure 7:
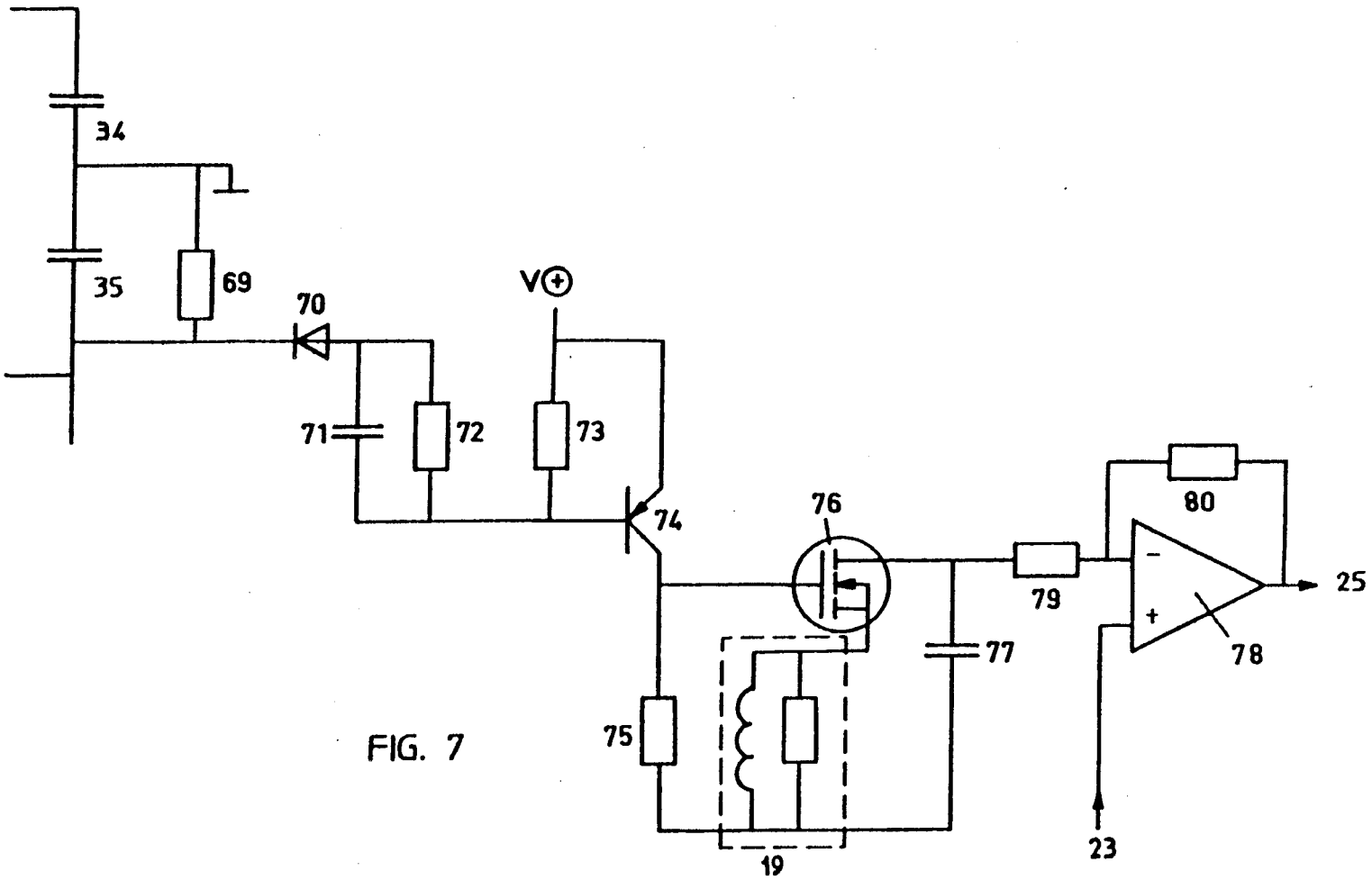
FIG. 7 is a detail view of an example of a part of the power circuit shown in FIG. 1.

In a preferred embodiment block 24 comprises a sample-hold circuitry, followed by an operational amplifier, which is connected as a P-controller. A possible embodiment suitable for the example shown in FIG. 3 of a power circuit according to the present invention is shown in FIG. 7 and will be described hereinafter.

Figure 3:
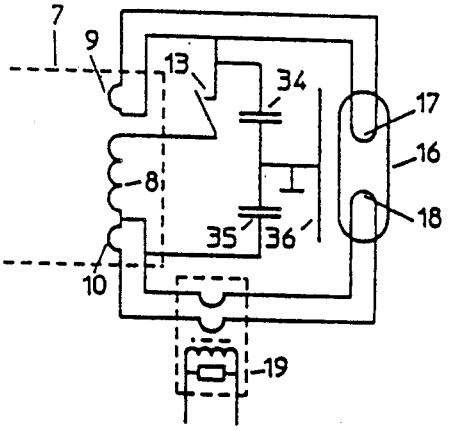
FIG. 3 shows an electric diagram of a variant of a part of FIG. 1.

Connected to capacitor 35 from FIG. 3 is a diode 70, which rectifies the negative peaks of the voltage of this capacitor. This voltage is smoothed by a capacitor 71 to which a resistor 72 is connected in parallel. The time constant of RC network 71,72 is large relative to the cycle time of the lamp voltage, e.g. five to fifty times as large. Capacitor 71 is now always charged at the negative peaks of the voltage across capacitor 35, after which capacitor 71 is slightly discharged through resistor 72. The charging current peaks of capacitor 71 set a transistor 74 connected to a positive auxiliary voltage V+ into the conductive state. This transistor, in its turn, sets MOSFET 76 into the conductive state, so that at the negative peaks of the lamp voltage, capacitor 77 is charged to a voltage proportional to the lamp current value as established at that moment by current measuring transformer 19. It should be noted that a MOSFET can be bidirectionally conductive. The voltage at capacitor 77 is now compared with the desired lamp current value 23, and the operational amplifier 78 connected as a P-controller, whose gain is determined by the ratio of resistor 79 and 80, generates the differential signal 25. Resistor 73 serves for preventing capacitive currents in diode 70 from setting transistor 74 into the conductive state in the cut-off phase of said diode at undesirable points of time. Resistor 69 provides the DC current path necessary for supplying DC current through diode 70 under all circumstances.

FIG. 1 shows that the voltage across auxiliary windings 9,10 increases when the lamp voltage increases, which is the case with the lowest lamp current.

The current ratio between the properly interconnected windings 8,9 and 10 is so chosen that at the lamp voltage occurring at the minimum lamp current, which may be lower by a factor of hundred than the maximum lamp current, the filaments are heated to such an extent that the gas discharge continues to be stable, even in the case of older lamps. The filaments, however, are not heated so strongly as to seriously shorten the lamp's service life.

Another possibility of controlling the lamp current is created by varying the duty cycle of conductance of transistors 2,3, at constant frequency.

This means essentially that then the effective value of the AC voltage of source 30 in FIG. 2 is altered. The resulting higher harmonics have little influence, since the filter, formed by inductor 31 and resonance capacitor 32, forms a second order low-pass filter. It is important that the voltage of source 30, at maximum duty cycle of 50% of transistors 2,3 from FIG. 1, is higher than the burning voltage of the lamp. When the duty cycle is now reduced, the effective voltage of source 30 drops and hence in the first instance, the current through inductor 31 is also lower. Subsequently, the resistance value of 33 increases due to the negative lamp characteristic, and so does, accordingly, the voltage across said resistor. Feedback through current measuring transformer 19 ensures a stable control. It will be clear that a combination of a duty cycle control and a frequency control is also possible.

In general, the desired value 23 of the lamp current will be obtained from the difference between a value of the lamp luminance measured by one or more suitable sensors 20, such as a photodiode or a phototransistor, and a desired value 22, originating from an adjusting means or machine control device.

The signal 23 can be formed e.g. by means of an operational amplifier connected as a so-called P-controller, or PI-controller, incorporated in block 21.

However, the determination of the average lamp luminance cannot be effected instantaneously due to inertia in the fluorescent lamp and also due to crossover of the high frequency signal of the lamp to the sensor. When for instance use is made of a stable photodiode as a luminance sensor, the signal is rather slight. Moreover, the lamp is often arranged for movement in a copying machine, while from considerations of production technology, preference is given to a flat cable for the connection between the stationary part of the machine and the carriage with lamp and light sensor. It will be clear that in that case, there will be a greater crossover between the high-frequency lamp voltage and the non-shielded connecting lead of the light sensor, as the flat cable referred to may be fifty cm long.

However, the light control can be performed rather slowly, because the lamp current control described ensures the continued stable burning of the lamp(s), so that the AC voltage signal can be filtered out of the light feedback signal without any objection.

During the switching-over to the stand-by mode, contact 13 is again opened by circuit 27 and is switched back to a low-duty cycle. If desired, the converter may also be entirely cut off.

FIG. 3 shows an alternative embodiment of the secondary circuit. Here, the resonance capacitor 14 from FIG. 1 has been replaced by two serially connected capacitors 34,35, while the junction of the capacitors is connected to ground and connected to a shield or metal reflector 36 arranged parallel to the lamp 16. In this manner, a completely symmetrical control of the lamp is ensured, so that wear on heating filaments 17,18 will be equal. The lamp can be fired at a lower voltage, since due to the effect of shield 36, a higher field strength occurs at the electrodes 17,18.

Figure 4:
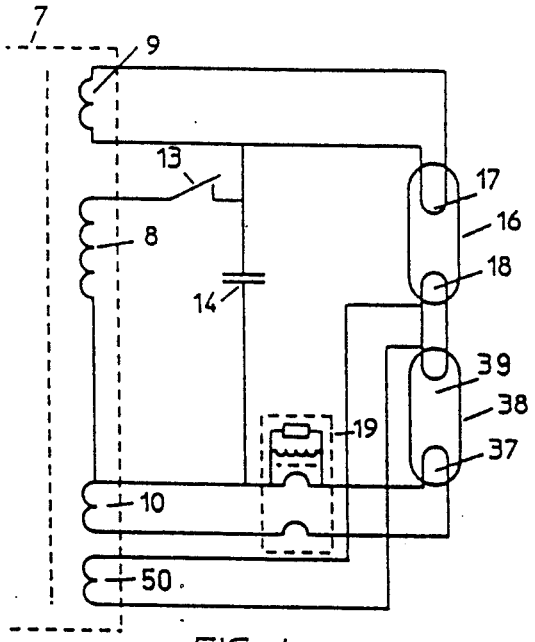
FIG. 4 diagrammatically shows an embodiment of a power circuit according to the present invention, adapted to energize more than one gas discharge lamp.

FIG. 4 shows an embodiment with two lamps. The additional lamp 38 is connected in series to lamp 16. The ends are connected in a manner similar to that of FIG. 1. However, the winding 8 should now supply the double voltage. Besides, filaments 39 and 18 are interconnected and connected to an additional floating auxiliary winding 50. This circuitry can be further extended, connecting always the non-terminal pairs of filaments to one another and to an additional floating auxiliary winding.

Figure 5:
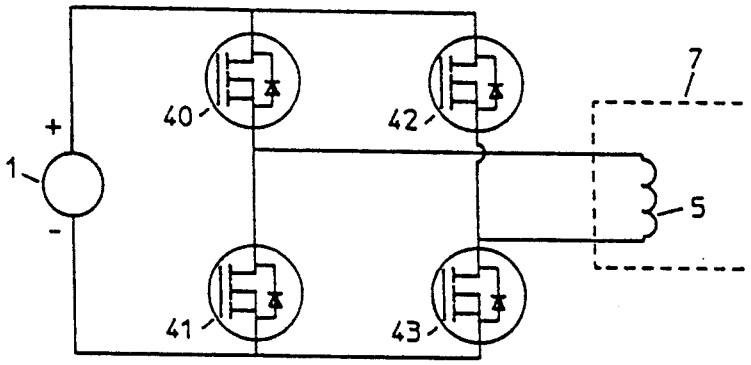
FIGS. 5 and 6 show alternative embodiments of a part of the power circuit shown in FIG. 1.

FIG. 5 shows a circuitry wherein the primary circuit is designed as a so-called full bridge circuit. Transistors 40,43 are simultaneously in the conductive state and at the same moment as 2 in FIG. 1, and transistors 41,42 are simultaneously conductive, too and at the same moment as 3 in FIG. 1.

Figure 6:
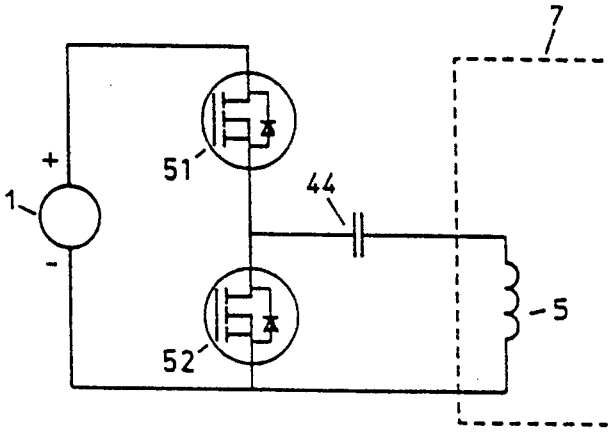

Finally, FIG. 6 shows a primary half bridge circuitry wherein an additional coupling capacitor 44 has been added. Furthermore, transistors 51,52 are conductive at the same moment as the transistors in FIG. 1.

It is observed that in view of the foregoing, various modifications will readily occur to the worker skilled in the art. For instance, in the stand-by mode, the resonance capacitor can also be disabled.

Control circuitry 4 may comprise a standard pulse width control IC type 3524 whose outputs 11,14 are connected to the control electrodes of transistors 2,3, and the differential amplifier of the IC is so connected that, in the stand-by mode, this controls the duty cycle in such a manner that the desired effective value for the heating filament voltage is attained, while in the normal mode, the maximum duty cycle is achieved. The signals required for setting the arrangement for normal mode or stand-by mode are provided by circuit 27, which also controls contact 13.

Frequency control is now achieved by providing an additional current depending on the signal 25 parallel to a fixed resistor connected between pin Rt(6) and the negative supply voltage. In this manner, the current mirror incorporated in the control IC applies to Ct a current depending on the signal 25, so that the oscillator frequency of the IC is influenced in the desired manner. Ct is the capacitor which is provided in the oscillator of the IC and which is connected between pin 7 and the negative supply voltage.

I claim:

1. A high frequency power circuit for energizing at least one gas discharge lamp with two filaments, said circuit being adapted to be supplied with power from a DC voltage source, said circuit comprising semiconductor switching elements and control means for the semiconductor switching elements, as well as a high frequency transformer having at least one primary winding which, in operation, is supplied with an AC voltage signal by the semiconductor switching elements, and having at least one secondary main winding and secondary auxiliary windings, said secondary auxiliary windings, in operation, energizing the filaments of the at least one gas discharge lamp, characterized in that the control means are adapted to disconnect in a stand-by mode, by at least one controllable switching means, the connection between the at least one secondary main winding and the at least one gas discharge lamp, and, in the stand-by mode, to supply such an AC voltage signal to the at least one primary winding that the filaments of the gas discharge lamp(s) are preheated through the secondary auxiliary windings.

2. A power circuit as claimed in claim 1, characterized in that the transformer is a leakage transformer and that at least one resonance capacitor is connected in parallel to the at least one secondary main winding.

3. A power circuit as claimed in claim 1, characterized in that the semiconductor switching elements supply the at least one primary winding, in operation, with a symmetrical AC voltage.

4. A power circuit as claimed in claim 1, characterized in that the at least one primary winding has a center tap which, in operation, is connected to the one pole of the DC voltage source, and that between each of the ends of the primary winding and the other pole of the DC voltage source, there is connected at least one semiconductor switching element.

5. A power circuit as claimed in claim 1, characterized in that the at least one primary winding, in operation, is connected to the poles of the DC voltage source through a whole or half bridge circuitry formed by the semiconductor switching elements.

6. A power circuit as claimed in claim 1, characterized in that the control means, when switching over from the stand-by mode to the normal mode, are adapted to first entirely block the semiconductor switching elements, subsequently, through the at least one switching means, to, effect the connection between the at least one secondary main winding and the gas discharge lamp(s), and thereafter to set the semiconductor switching elements alternately into the conductive state with a gradually increasing duty cycle.

7. A power circuit as claimed in claim 6, characterized in that at least during the switching over to the normal mode, the frequency at which the semiconductor switching elements are alternately set into the conductive state corresponds approximately with a resonance frequency determined by the resonance capacitor and the leakage inductance of the transformer.

8. A power circuit as claimed in claim 2, characterized in that the at least one resonance capacitor can be disabled by means of a controllable switching means.

9. A power circuit as claimed in claim 2, characterized in that the resonance capacitor is formed by two serially connected capacitors, whose interconnected electrodes are connected to ground and are connected to a shield positioned beside the at least one lamp.

10. A power circuit as claimed in claim 1, characterized by a current measuring device for measuring the actual value of the current flowing through the at least one lamp, and by a differential amplifier, which applies to the control means a signal that corresponds with the difference between the measured actual value of the lamp current and a predetermined desired value of the lamp current.

11. A power circuit as claimed in claim 10, characterized in that the control means are adapted to control the frequency of the signal supplied by the semiconductor switching element, in response to the signal supplied by the differential amplifier.

12. A power circuit as claimed in claim 10, characterized in that the control means are adapted to control the duty cycle of the semiconductor switching elements in response to the signal supplied by the differential amplifier.

13. A power circuit as claimed in claim 10, characterized in that the current measuring device comprises a current transformer formed by a winding about the connecting wires extending between at least one of the filaments of the gas discharge lamp and the associated secondary auxiliary winding.

14. A power circuit as claimed in claim 10, characterized in that the current measuring device comprises a sample-hold circuit, which samples and holds the peak value of the measured current.

15. A power circuit as claimed in claim 1, characterized by a light sensor device, which produces an electrical signal proportional to the luminance of the light emitted, in operation, by the at least one lamp.

16. A power circuit as claimed in claim 15, characterized by a comparator, which compares the electrical signal proportional to the luminance with a predetermined desired signal and which produces an electrical signal proportional to a desired lamp current.

17. A power circuit as claimed in claim 1, adapted to energize two or more serially connected gas discharge lamps, characterized in that the secondary main winding is connected to the ends of the circuit of serially connected lamps and that the filaments located at the interconnected ends of two lamps are connected in series through a common secondary auxiliary winding.

* * * * *